US011667047B2

(12) United States Patent
Mayr

(10) Patent No.: US 11,667,047 B2
(45) Date of Patent: Jun. 6, 2023

(54) BLADE, SLICING MACHINE EQUIPPED THEREWITH AND METHOD OF OPERATING THE SLICING MACHINE

(71) Applicant: TVI ENTWICKLUNG & PRODUKTION GMBH, Bruckmuehl (DE)

(72) Inventor: Martin Mayr, Eiselfing (DE)

(73) Assignee: TVI ENTWICKLUNG & PRODUKTION GMBH, Bruckmuehl (DE)

( * ) Notice: Subject to any disclaimer, the term of this patent is extended or adjusted under 35 U.S.C. 154(b) by 26 days.

(21) Appl. No.: 17/120,962

(22) Filed: Dec. 14, 2020

(65) Prior Publication Data

US 2021/0178620 A1 Jun. 17, 2021

(30) Foreign Application Priority Data

Dec. 16, 2019 (DE) ..... 102019134530.8

(51) Int. Cl.
*B26D 1/00* (2006.01)
*B26D 1/143* (2006.01)

(52) U.S. Cl.
CPC ..... *B26D 1/0006* (2013.01); *B26D 1/143* (2013.01); *B26D 2001/0053* (2013.01); *B26D 2210/02* (2013.01)

(58) Field of Classification Search
CPC ..... B26D 1/006; B26D 1/143; B26D 1/00; B26D 1/14; B26D 2001/0053; B26D 2210/02; B26D 7/08
USPC ..... 30/346
See application file for complete search history.

(56) References Cited

U.S. PATENT DOCUMENTS

| | | | | |
|---|---|---|---|---|
| 2,472,876 | A * | 6/1949 | Ahrndt | B26D 1/0006 D15/127 |
| 10,710,259 | B2 | 7/2020 | Volkl et al. | |
| 2015/0158194 | A1* | 6/2015 | Krauss | B26D 1/0006 83/13 |
| 2018/0345519 | A1* | 12/2018 | Völkl | A22C 17/002 |
| 2019/0160697 | A1* | 5/2019 | Henry | B23P 15/28 |

FOREIGN PATENT DOCUMENTS

| | | | | |
|---|---|---|---|---|
| CA | 2811903 | A1 * | 10/2013 | B26D 1/0006 |
| DE | 10 2004 016 615 | A1 | 10/2005 | |
| DE | 10 2011 103 462 | A1 | 12/2012 | |
| DE | 10 2016 005 443 | A1 | 11/2017 | |

(Continued)

OTHER PUBLICATIONS

German Search Report Dated Oct. 19, 2020 (with English Machine Translation), Application No. 10 2019 134 530.8, Applicant TVI Entwicklung und Produktion GmbH, 15 Pages.

*Primary Examiner* — Nhat Chieu Q Do
(74) *Attorney, Agent, or Firm* — Brooks Kushman P.C.

(57) ABSTRACT

A rotatable blade with a front side and a back side, for use in a slicing machine, includes a curved peripheral edge formed as a cutting edge defining a blade plane. On the back side of the blade, the cutting edge is adjoined by a first surface which is inclined obliquely to the blade plane, extends radially inwards and is at an acute cutting angle to the blade plane. A second surface of the blade follows the first surface radially inwards on the back side of the blade, and the blade has a same thickness over an entire radial extension of the second surface.

21 Claims, 5 Drawing Sheets

(56) References Cited

FOREIGN PATENT DOCUMENTS

| | | | | | |
|---|---|---|---|---|---|
| DE | 10 2017 112 177 | A1 | | 12/2018 | |
| EP | 2799193 | A1 | * | 11/2014 | ..... B26D 1/0006 |
| WO | 2015/059016 | A1 | | 4/2015 | |

* cited by examiner

BLADE, SLICING MACHINE EQUIPPED THEREWITH AND METHOD OF OPERATING THE SLICING MACHINE

CROSS-REFERENCE TO RELATED APPLICATION

This application claims priority to German Patent Application No. DE 102019134530.8 filed on Dec. 16, 2019, the disclosure of which is incorporated in its entirety by reference herein.

TECHNICAL FIELD

The invention relates to the cutting of a material to be cut into slices—in particular slices of precise weight—which should be separated as proper as possible.

BACKGROUND

The production of such slices or portions from an elastic strand material is relatively problem-free if this strand material has the same cross-section over its length and consists of a homogeneous material that can be cut in the same way everywhere, such as an industrially produced sausage strand or cheese strand.

So-called slicers are known for that, which

- either by means of a round rotating blade, which can be moved back and forth across the strand
- or by means of a sickle-shaped blade whose axis of rotation is stationary during operation and whose cutting edge is located at the outer circumference of the sickle, cut one slice each from the strand material, while the strand, which is usually exposed, is moved forward continuously or only between the cutting processes.

However, an irregularly shaped piece of meat such as a grown piece of meat does not have these properties, because each of these irregular pieces of meat has a different shape and, in addition, a cross-section that changes over its length and can also consist of materials of different consistency, hardness and elasticity, for example the fat content, the pure muscle meat and/or the surrounding silver skin.

For the purposes of the present invention, the material to be cut is referred to as a piece of meat, without limiting the invention to meat as cut material, so that it can also be irregularly and undefinably shaped pieces of another material.

In this context, it is already known to first deform such a piece of meat so that it has a defined, known cross-section, in particular at least at the end where the next slice is cut off, if slicing is carried out afterwards, at least at the time of cutting the slice—preferably over the entire length.

Then a relation between the adjustable thickness of the slice and the weight of the slice can be set using its usually known or estimable specific weight.

Irrespective of this, the quality of the cut—for example, a fray-free cutting edge of the slice, a constant slice thickness over its entire surface, etc.—is the better, the less pressure in the direction of penetration the blade dips into the material to be cut, the less resistance the material opposes the blade and, in this context, also the more the cut is a tensioning cut, i.e. the greater the tension factor.

The tension factor is understood to be the relation between penetration speed perpendicular to the cutting edge at the penetration point and the circumferential speed of the blade along the blade edge, especially when the cutting edge makes initial contact with the material to be cut.

In addition to the quality of the cut, it is also very important to place the cut-off sheet in the correct position and without wrinkles.

SUMMARY

It is therefore the object according to the invention to provide a blade as well as a slicing machine equipped with said blade and an operating method for the slicing machine, with which an optimal slicing result as well as a correct placement of the cut-off slice is achieved, as independent as possible of the consistency of the material to be sliced and especially of the differences in consistency within the material to be sliced.

A generic, rotatable or rotating blade is generally plate-shaped or slightly bowl-shaped and has a curved peripheral edge on its circumferential edge—usually viewed in the axial direction, i.e. towards the main plane of the blade—which is at least partially manufactured as a cutting edge, i.e. viewed in radial cross-section, tapers outwards at an acute-angled cutting angle, which is usually greater than 20°.

To create this cutting edge, the blade is generally sharpened from only one side, which is defined here as the back side. From the plane of the blade, which is defined by the cutting edge, this ground surface, which is part of the rear side, rises radially inwards at an acute cutting angle.

In a state-of-the-art rotary blade, this grinded surface is usually followed radially inwards by a connecting surface which is also at an acute angle to the blade plane, but less than the cutting angle.

According to the invention, on the other hand, a regrinding area of the blade is connected radially inwards to this grinded surface on the back of the blade as a connecting surface, over the entire radial extension of which the blade has the same thickness. This connecting surface therefore runs parallel to the blade plane.

The regrinding area extends in the circumferential direction, preferably along the entire length of the cutting edge.

As a result, when regrinding the grinded surface—provided this is done at the same cutting angle that the ground surface has assumed from the start with respect to the blade plane—the thickness of the blade in the area of the ground surface and the regrinding area does not change and therefore the radial extension of the ground surface does not change, so that the blade always has the same parameters and relations with regard to cutting angle, radial extension of the grinded surface, thickness of the blade, especially at the transition between the grinded surface and the radially inwardly adjoining connecting surface, over the entire regrinding area and thus independently of the state of wear.

Thus, the regrinding area is arranged radially between the grinded surface and another connecting surface, and in particular is directly adjacent to at least one of them, in particular both of them.

In this context, equal or constant thickness means a thickness with deviations that are unavoidable in the manufacturing process of the blade, in particular that the thickness in the regrinding area differs by less than 0.5 mm, better by less than 0.3 mm, better by less than 0.2 mm, better by less than 0.1 mm between the greatest and smallest thickness of the blade in this regrinding area.

These permissible deviations are so small in particular because in the regrinding area the thickness of the blade should in any case be a maximum of only 2 mm, better only a maximum of 1.5 mm better, only a maximum of 1.1 mm.

The radial extension of the regrinding area is max. 20 mm, better only max. 15 mm, better only max. 11 mm.

With the specified thickness of the blade in the regrinding area, this is sufficient for sufficient stability of the blade in the regrinding area for almost all slicing materials in the food sector.

If the blade is a dish-shaped, concave blade, the indentation on the concave front side of the blade preferably begins only radially within the regrinding area, so that the front side of the blade in the regrinding area and up to the cutting edge is a flat surface if necessary.

Particularly with the specified dimensions in the regrinding area, the adhesive forces between the material to be cut and the blade or the slice and the blade are still so low that a proper cut through, i.e. especially without fringes on the cut edges of the slice, and a proper deposit can be achieved.

Since the correct placement of the slice depends on whether the slice is always ejected from the blade in the same way, there is a connecting surface offset radially inwards from the regrinding area, which preferably runs at an angle to the blade plane in the radial direction and thus increasingly moves away from the blade plane in the axial direction and serves as a deflector shoulder which guides the outer circumference of the cut-off slice arriving there away from the blade plane in the axial direction and is intended to produce a defined ejection.

Accordingly, this deflector shoulder also extends in circumferential direction over the entire length of the cutting edge.

The deflector shoulder can bridge the distance in axial direction between the creep area and a further connecting surface located further inwards and axially further away from the blade plane, or it can even project beyond the radially outer edge of this next connecting surface in axial direction and form a deflector bead to ensure sufficient axial extension of the deflector shoulder.

The next connecting surface can run parallel to the blade plane or be inclined to it, i.e. run radially inwards with increasing distance to the blade plane, or have any other, arbitrary design.

Preferably, the deflector shoulder cut in radial direction has a larger deflector angle to the blade plane than the grinded surface, i.e. than the cutting angle, which is usually already larger than 20°, since the slice is primarily deflected in axial direction by this deflector shoulder and less by the grinded surface.

Of the several connecting surfaces spaced apart in the radial direction at different distances from the blade plane—regardless of whether the connecting surfaces are parallel or at an angle to the blade plane—one each can be designed as a deflector shoulder as described above.

The above-described design of the blade can be present both in a sickle-shaped blade, in which the outer peripheral contour of the blade designed as a cutting edge increases in the peripheral direction counter to the direction of rotation of the blade during operation of the latter, and in a blade with a cutting edge which rotates in the form of a circular ring, is closed in the form of a ring or extends only over one segment, i.e. in particular a circular disk-shaped blade.

A circular disc-shaped blade in particular can be plate-shaped, i.e. in particular with a flat front side, or bowl-shaped, with a concave indentation in the center in the front of the blade.

A slicing machine known per se, in which the blade according to the invention can also be used, comprises a cutting unit which has such a prescribed blade, whereby, depending on the basic shape of the blade—sickle-shaped or circular disk-shaped cutting edge—the axis of rotation of the blade, i.e. the blade axis, is stationary during operation or must be moved for penetrating into the material to be sliced.

In addition, a product support is provided on which the product to be cut, i.e. the product, is placed and fed to the cutting unit and pushed forward along the product support during slicing, whereby the support surface for the product to be cut is preferably inclined obliquely downwards towards the cutting unit with respect to the horizontal.

With regard to the method of operating such a slicing machine and/or shaping the cutting edge of the blade, the aim is to achieve the highest possible pulling factor of the drawing cut, at least when the material to be sliced is contacted by the blade at the point of contact.

With a sickle-shaped blade, this can be achieved by shaping the cutting edge in relation to the point of contact between the sickle-shaped blade and the material to be cut, which depends on the shape of the product and the support position.

In the case of a blade with a circular ring-shaped, endless cutting edge, i.e. a circular disk-shaped blade, the blade axis is displaced during operation, usually oscillating, whereby the return stroke serves to bring the blade completely out of the path of movement of the material to be cut when viewed in the feed direction.

However, the movement of the blade should be controlled in such a way that for the blade to dip into the product to be cut, the contact of the cutting edge with the product to be cut is made as soon as possible after the blade has reached the position furthest away from the product support.

Since from this reversal point of the oscillating blade movement, the blade axis must be accelerated from standstill for the forward stroke, the speed in the plunging direction, i.e. perpendicular to the cutting edge, is the lower the shorter the time available for acceleration in this plunging direction and thus also the shorter the distance from the reversal point of the blade axis until the cutting material is contacted by the cutting edge.

The lower the immersion speed, the higher the tension factor, which should be at least 1 to 15.

In order to have enough time to push the cutting material forward for cutting the next slice, the blade axis can be stopped in its oscillating movement at the reversal point, or the movement of the blade axis can be slowed down in the area of the reversal point.

Preferably, at the reversal point of the blade axis, the cutting edge should not be more than 50 mm, better not more than 30 mm, better not more than 20 mm away from the circumference of the material to be cut in order to achieve the desired low penetration speed.

BRIEF DESCRIPTION OF THE DRAWINGS

Types of exemplary embodiments according to the invention are described in more detail below as examples, with reference to the following drawings which show.

DETAILED DESCRIPTION

Figure 1A:
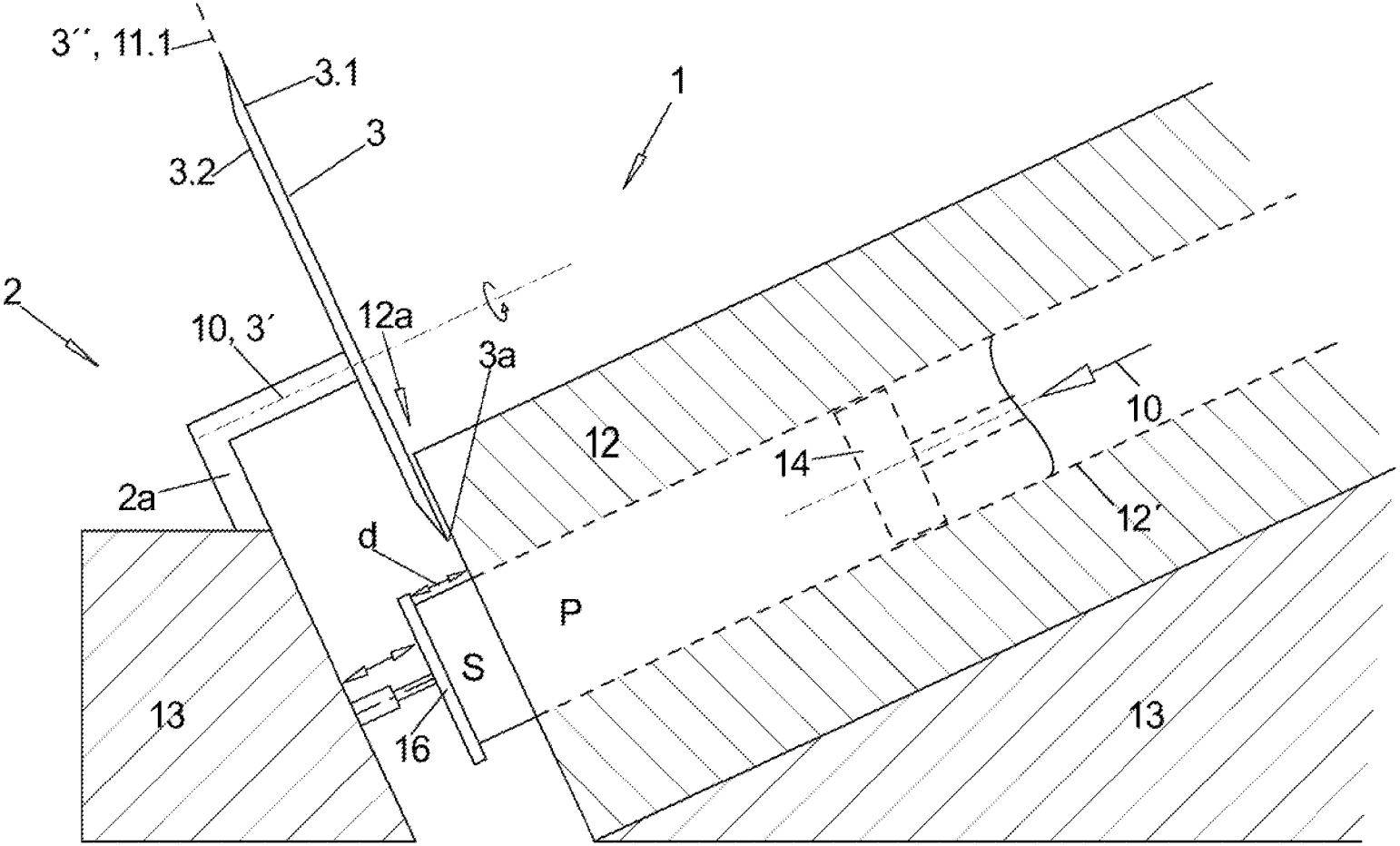
FIG. 1*a*: a slicing machine cut in longitudinal pressing direction with a sickle blade.
Figure 2A:
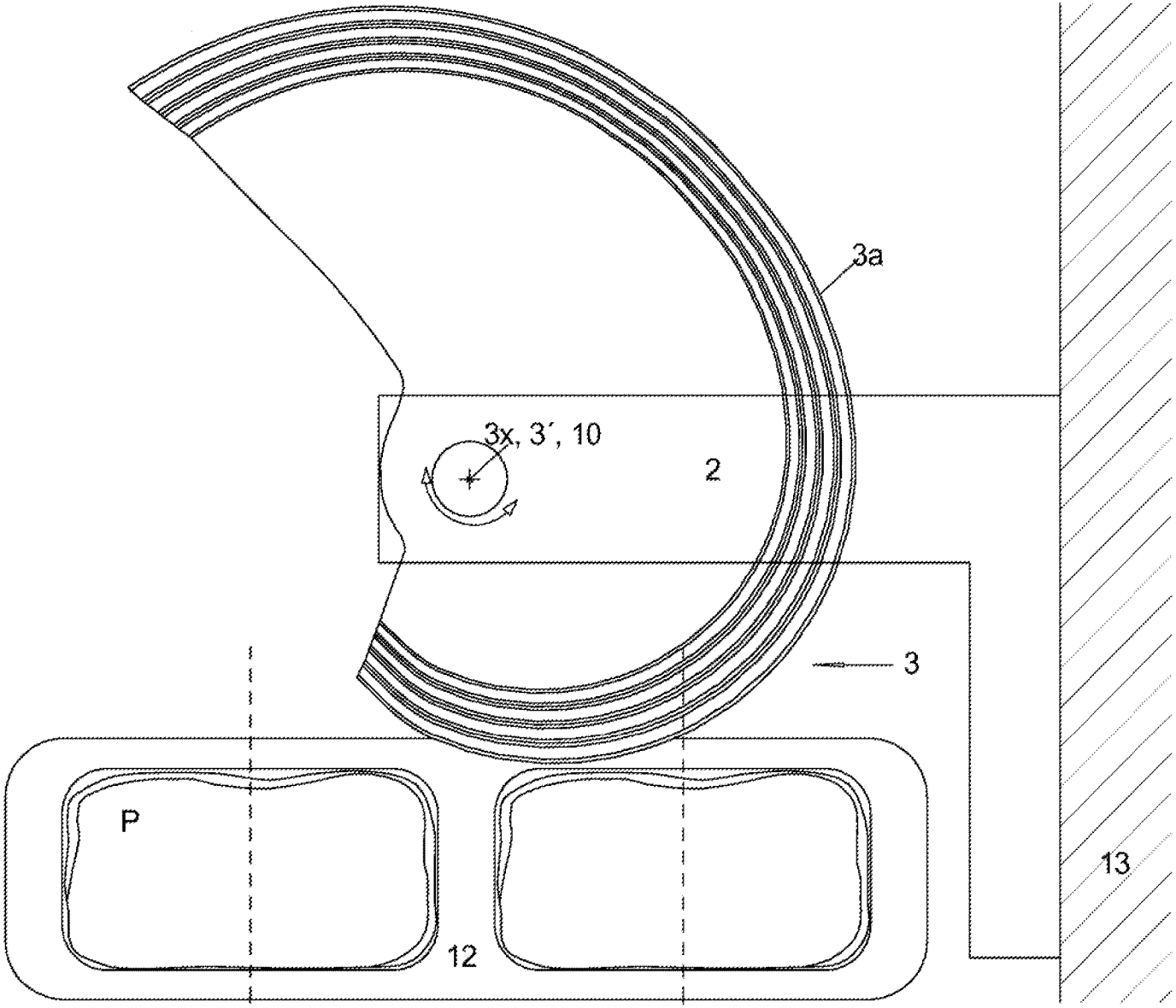
FIG. 2*a*: the slicing machine as shown in FIG. 1*a*, viewed in the longitudinal pressing direction from the cutting end of the forming tube.

FIGS. 1*a* and 2*a* show state-of-the-art slicing machines, whereby the front views in accordance with FIGS. 2*a* and 2*b* already show the design of the blade 3 according to the invention, the cross-section of which will be explained in more detail in FIGS. 3-3*c*.

The slicing machines according to FIGS. 1*a*, 1*b*, 2*a* and 2*b* have on the one hand—in addition to the base frame 13 of the machine—a cutting unit 2, which also includes the rotating blade 3, and on the other hand a product support 12' directed diagonally downwards towards the blade 3, on which the product P to be sliced, in particular a grown piece of meat, rests and is pushed forward in steps for slicing into slices S.

In this case, the product support 12' is not a simple support surface, but a circumferentially closed form tube 12, which is open on both ends and in which the product P is not only pushed forwards for cutting by a longitudinal press stamp 14, but can also be pressed in the longitudinal direction by this longitudinal press stamp 14 beforehand, so that the product P has a uniform cross-section over the length by resting against the inner circumference of the form tube cavity 15.

The stop plate 16 can be used as a stop in the longitudinal pressing direction 10 for the pressing process. This stop plate 16 can be adjusted to a certain thickness setting d in the form of a distance in the longitudinal pressing direction 10 from the front end, the cutting end 12*a* of the form tube 12, for cutting off the slices S. However, the stop plate 16 can also be used as a longitudinal stop when pressing the product P by direct contact to the front end face of the form tube 12, since the stop plate 16 has a size that can completely cover the cross-section of the form tube cavity 15 at the cutting end 12*a*.

Figure 1B:
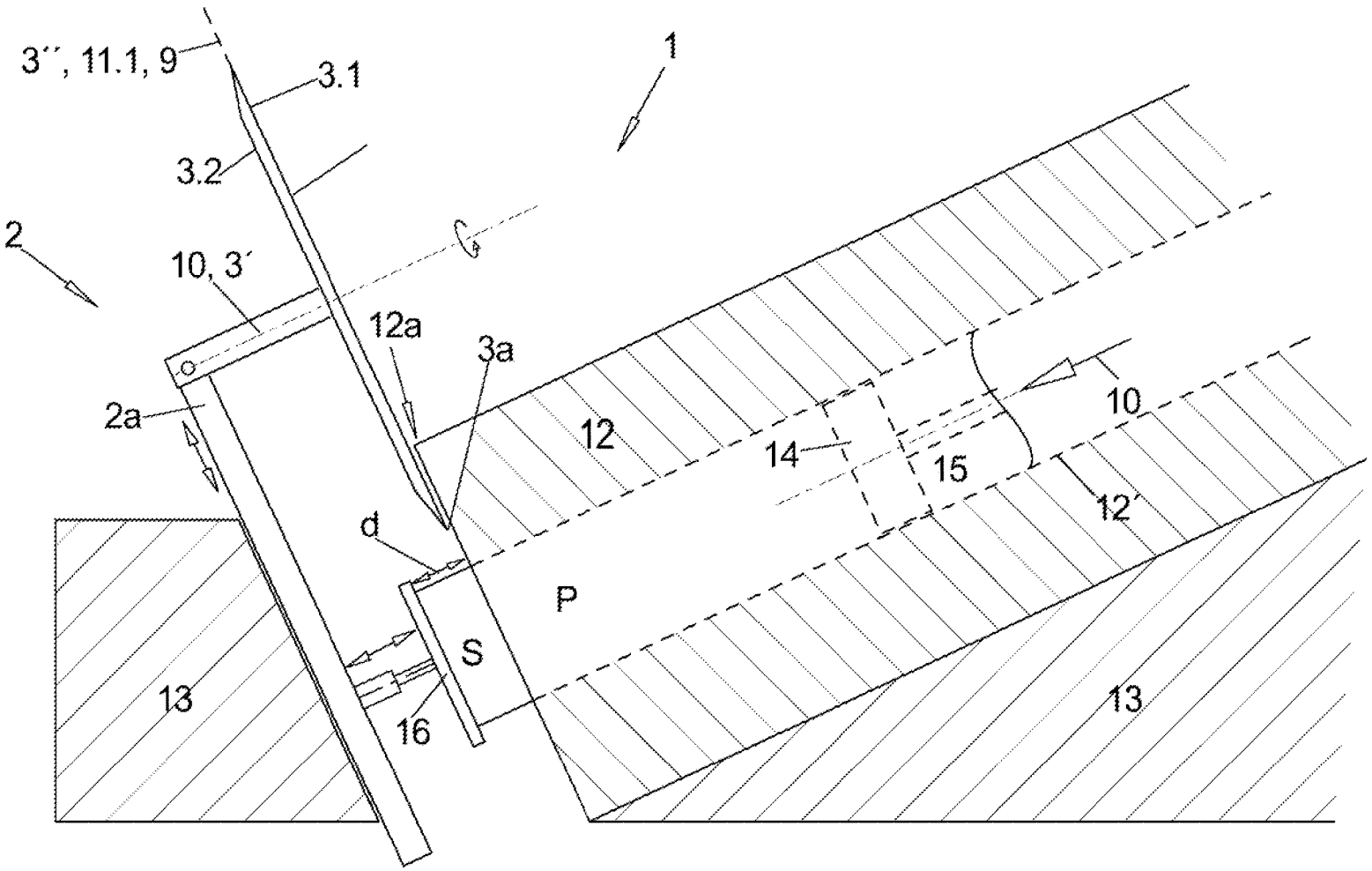
FIG. 1*b*: A slicing machine with a circular disk-shaped blade or a circular segment-shaped blade in the same viewing direction.

The stop plate 16 can either be attached to the base frame 13 and be adjustable in its axial position as shown in FIG. 1*a* or be attached to the blade carrier 2*a* as shown in FIG. 1*b*.

Figure 2B:
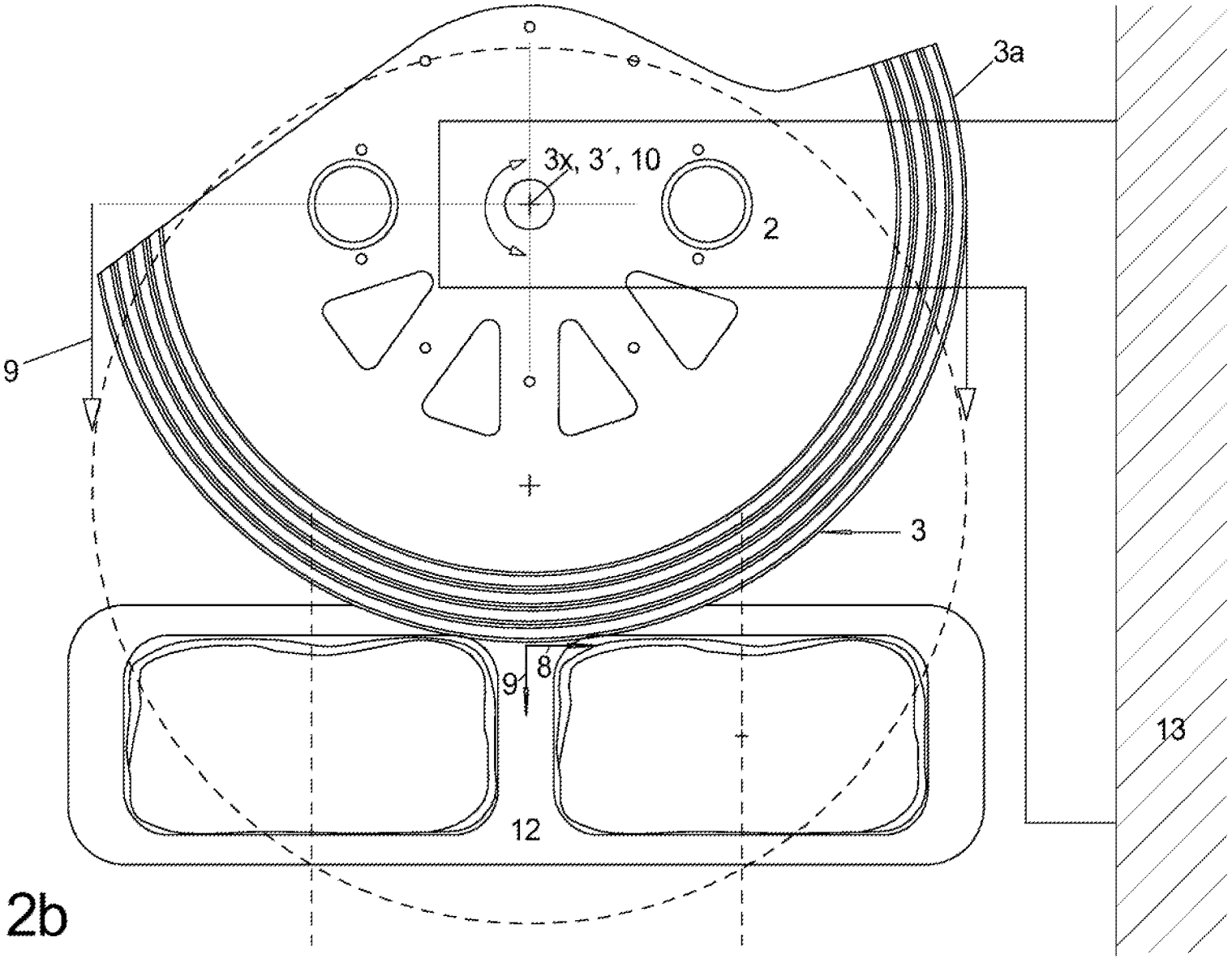
FIG. 2*b*: the slicing machine according to FIG. 1*b*, viewed in longitudinal pressing direction from the slicing end of the forming tube.

This depends on whether the blade 3 is a sickle blade 3 according to FIGS. 1*a* and 2*a*, or a circular disk-shaped blade or a circular segment-shaped blade according to FIGS. 1*b* and 2*b:*

In the sickle-shaped blade 3, the outer circumferential edge, designed as cutting edge 3*a*, has an increasing distance from the rotary object 3' in the direction of travel. At the end of the cutting edge 3*a*, this largest distance between the cutting edge 3*a* and the rotation axis 3' is much larger than the smallest distance between the rotation axis 3' and the part of the circumference that is not manufactured as cutting edge 3*a*, as the radial extension of the form tube cavity 15 or the product P.

In contrast to FIGS. 1*a* and 2*a*, in which the circular disk-shaped blade 3 only comes out of the overlap with the form tube cavity 15 by moving the entire blade 3 including the blade axis 3' oscillating in the direction of penetration 9 in the direction of form tube 12 so that the form tube cavity 15 is completely within the flight circle and the real blade 3.

The latter is particularly important if, instead of a circular disk-shaped blade, it is a segmented circular blade in which the cutting edge 3*a*, which is concentric with the blade axis 3', extends over only part of the circumference.

FIGS. 1*a*, 1*b*, 2*a* and 2*b* show a slicing machine 1 with two parallel adjacent form tube cavities 15, here formed in a single form tube 12, whereby the blade 3 cuts a slice S from each of the two products P located in the two form tube cavities 15 during a separation process, in which it has a correspondingly large diameter or circle of flight.

Accordingly, in FIG. 1*a*, the solution with a sickle-shaped blade 3 is attached with its blade axis 3', which in this case also runs in the longitudinal pressing direction 10, to a blade carrier 2*a* of the cutting unit 2, which is fixed to the base frame 13.

In contrast, in the case of FIG. 1*b* with circular disk-shaped blade 3 or circular segment-shaped blade 3, the blade carrier 2*a*, in which the blade axis 3' of the blade 3 is mounted, can be moved in a first cross direction 11.1 to the longitudinal pressing direction 10 in relation to the base frame 13 of the slicing machine 1 in an oscillating manner and driven accordingly.

Figure 3:
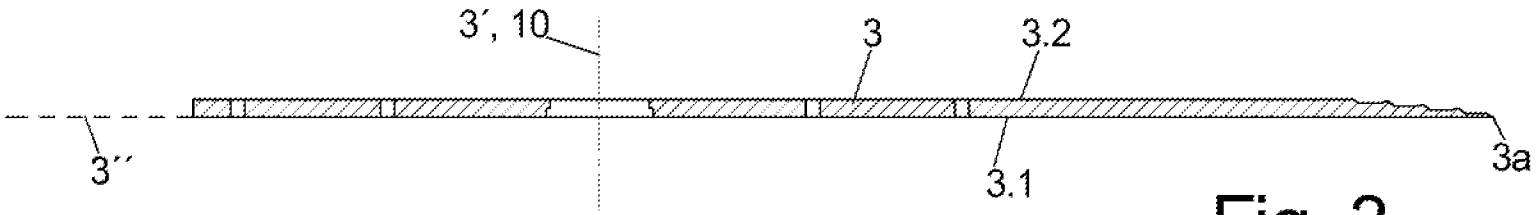
FIG. 3: a radial cut through the sickle blade of FIGS. 1*a* and 2*a*, FIG. 3*a*: a detail enlargement of this, FIGS. 3*b, c*: Detail enlargements from FIG. 3*a* with different transition between the regrinding area and the rest of the blade cross-section.

The stop plate 16 is also attached to the blade carrier 2*a*, since it should move together with the blade 3 oscillating in the first cross direction 11.1, the penetration direction 9, which in this case is perpendicular to the cutting edge tangent 8. The inventive design of the blade 3 is better seen in FIGS. 3-3*c*, which show a section through the blade 3 in a radial plane to the blade axis 3':

FIG. 3 shows a sickle-shaped blade 3 in a radial cut that runs through the blade axis 3'. However, the area near the cutting edge 3*a* relevant for the present invention is in this sectional view the same for a sickle-shaped blade and for acircular disk-shaped or circular segment shaped blade as shown enlarged in FIG. 3*a*, of which FIG. 3*b* again shows an enlargement near the cutting edge 3*a* during the cutting off of a slice S.

Figure 3A:
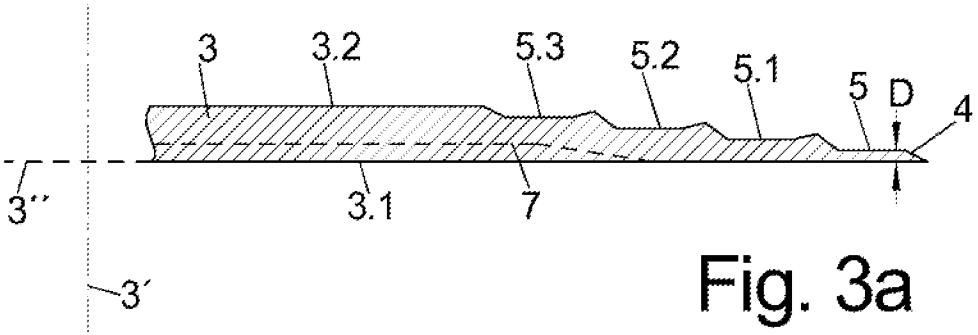
Figure 3C:
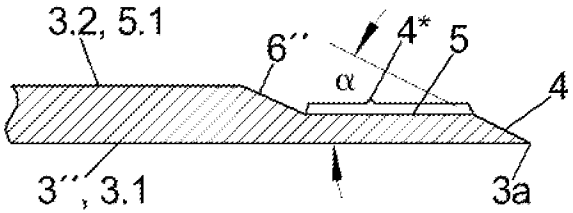

However, the simplest version according to the invention is visible in the sectional view of FIG. 3*c:*

The plate-shaped blade 3 has a cutting edge 3*a* in the form of a sharply ground outer circumferential edge, whereby grinding is only performed from one side:

Therefore, the cutting edge 3*a* is formed by the blade front side 3.1, which is flat in the radially outermost area and thus also lies in the blade plane 3", on the one hand, and a first surface or grinded surface 4, which is inclined thereto, on the other hand, which runs along the circumference and preferably everywhere along the circumference has the same cutting angle $\alpha$ in relation to the blade plane 3" and, when viewed from above, i.e. in the direction of the blade axis 3', also has the same width, as can best be seen in FIGS. 2*a* and 2*b*.

The radially inner end of the grinded surface 4, which is higher than the blade plane 3", is followed by a second surface or connecting surface 5 which extends radially further inwards over a so-called regrinding area 4*.

However, the most important thing is that this first connecting surface is parallel to the front side 3.1 of the blade, i.e. blade 3 in radial direction along the regrinding area 4* has the same thickness D everywhere, both in radial direction and circumferential direction within this regrinding area 4*.

This has the advantage that when regrinding the blade 3—whereby the abrasive is always applied to the grinded surface 4 over its entire radial extension, and by material removal this grinded surface 4 is moved further radially inwards towards the blade axis 3' with a constant cutting angle $\alpha$—the blade 3 retains the regrinding area 4* in its outermost area the same thickness D over the entire duration of its use, because the maximum regrinding is carried out to the radially inner end of the regrinding area 4*.

Due to the small thickness D in the regrinding area described above, it is obvious that the radial extension of the regrinding area 4* must not be too large in relation to this in order not to impair the stability of the blade in its radially outer area.

A further connection surface 5.1 is arranged radially from the connecting surface 5—which is an annular or partially annular surface—which in this case again runs parallel to the blade plane 3", i.e. usually also the front side 3.1 of the blade, but is axially spaced from it at a greater distance than the connecting surface 5, which is located in the regrinding area 4*.

The axial height difference between them is overcome by a 6" deflector shoulder, which is positioned at a deflection angle β to the blade plane 3", progressively in radial direction.

Figure 3B:
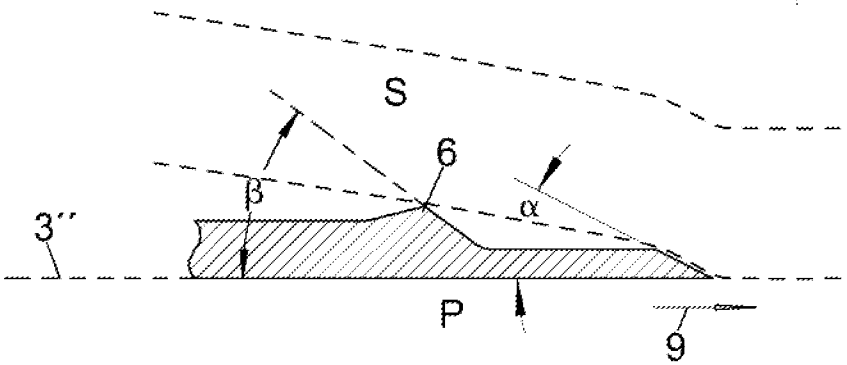

This deflector shoulder 6" serves to ensure that the slice S cut off from the cutting edge 3*a* is not only deflected from the blade plane 3" by the grinded surface 4 alone and deflected slightly in the axial direction 10—as can be seen more clearly in FIG. 3*b*—but is also supported by the deflector shoulder 6" which, at least with its upper edge, also rests on the slice S already cut off and deflects it further in the axial direction 10, in the direction of the blade axis 3'.

This is because the more defined the guidance of the partially separated disk S away from the separation point, the more correctly, i.e. in the correct position and without any creases, the disk S is dropped onto the intended impact point, which is usually located on a conveyor or in a collecting tray.

For this purpose, the deflector shoulder 6" can also be designed axially longer than the axial difference between the two adjoining connecting surfaces 5 and 5.1 would allow with an unchanged deflection angle β, in that the deflector surface 6" extends in the axial direction even beyond the radially outer edge of the radially inner adjoining next connecting surface 5.1 and forms a deflector bead 6, which generally runs parallel and concentrically to the cutting edge 3*a* along its entire extension.

As shown in FIG. 3*a*, the outermost connecting surface 5, which defines the regrinding area 4*, can be joined radially inwards by other connecting surfaces 5.1, 5.2, 5.3.

The other connecting surfaces from 5.1 can run parallel to the blade plane 3" or be inclined to it, i.e. radially inwards towards the blade axis 3' with increasing distance to the blade plane 3".

Furthermore, the deflector shoulder 6" between the individual connecting surfaces does not have to be designed as a deflector bead.

As especially FIGS. 3*b* and 3*c* show, the deflection angle β is usually larger than the cutting angle α.

Furthermore, FIG. 3*a* shows that the blade 3 can also have a concave indentation 7 on its front side 3.1 and can therefore be a bowl-shaped or dish-shaped blade, whereby, viewed radially from the outside inwards, the indentation 7 preferably starts further inwards from the radially inner end of the regrinding area 4*, in this case at the connection surface 5.2, in order to ensure that the thickness of the blade 3 does not fall below a specified blade thickness in any radial area.

LIST OF REFERENCE SIGNS

1 slicing machine
2 cutting unit
2*a* blade carrier
3 blades
3' blade axis, rotation axis
3" blade plane
3.1 front side
3.2 rear side
3*a* cutting edge
4 grinded surface
4* regrinding area
5.1, 5.2 connecting surface
6 deflector bead
6" deflector shoulder
7 indentation
8 cutting edge tangent
9 penetration direction
10 longitudinal pressing direction, axial direction
11.1, 11.2 cross direction
12 form tube
12*a* cutting end
12' product support
13 base frame
14 longitudinal press stamp
15 form tube cavity
16 stop plate
α cutting angle
β deflection angle
d thickness, thickness adjustment (slice)
D thickness (regrinding area)
P product, material to be cut
S slice

The invention claimed is:

1. A rotatable blade with a front side and a back side, for use in a slicing machine, the blade comprising:

a curved peripheral edge formed as a cutting edge defining a blade plane, wherein on the back side of the blade, the cutting edge is adjoined by a first surface which is inclined obliquely to the blade plane, extends radially inwards relative to a blade axis of the blade and is at an acute cutting angle to the blade plane, wherein a second surface of the blade follows the first surface radially inwards on the back side of the blade, and the blade generally has a same thickness in an axial direction over an entire radial extension of the second surface, wherein, on the back side of the blade, radially further inwards from the second surface, there are multiple connecting surfaces which are each axially further away from the blade plane than the second surface, and at least an axial distance between a first connecting surface of the multiple connecting surfaces and the second surface is bridged by a deflector shoulder on the back side, which is inclined obliquely to the blade plane, wherein the second surface is arranged radially between the first surface and the deflector shoulder, each connecting surface of the multiple connecting surfaces runs parallel to the blade plane, and each transition from one to another connecting surface of the multiple connecting surfaces is configured as an additional deflector shoulder.

2. The blade according to claim 1, wherein the first connecting surface is positioned adjacent the deflector shoulder and extends radially inward of the deflector shoulder, and the deflector shoulder projects further beyond the blade plane transversely to the blade plane than the first connecting surface.

3. The blade according to claim 1, wherein the deflector shoulder has a larger deflection angle in a radial direction to the blade plane than the first surface.

4. The blade according to claim 1, wherein thicknesses of the blade over the entire radial extension of the second surface differ by less than 0.5 mm.

5. The blade according to claim 4, wherein the thicknesses of the blade over the entire radial extension of the second surface differ by less than 0.3 mm.

6. The blade according to claim 4, wherein the thicknesses of the blade over the entire radial extension of the second surface differ by less than 0.1 mm.

7. The blade according to claim 1, wherein the cutting edge is a finite cutting edge in a shape of a circular-segment disc or sickle.

8. The blade according to claim 1, wherein the thickness of the blade over the radial extension of the second surface is a maximum of 2 mm, and the radial extension of the second surface is a maximum of 20 mm.

9. The blade according to claim 8, wherein the thickness of the blade over the radial extension of the second surface is a maximum of 1.1 mm, and the radial extension of the second surface is a maximum of 11 mm.

10. The blade according to claim 8, wherein the thickness of the blade over the radial extension of the second surface is a maximum of 1.5 mm, and the radial extension of the second surface is a maximum of 15 mm.

11. A slicing machine comprising:

a cutting unit with the rotatable blade according to claim 1, and a product support for receiving a product.

12. The slicing machine according to claim 11, wherein when the blade has a finite, curved cutting edge and the blade axis is stationary during operation, a shape of the cutting edge is configured in such a way that, when the blade dips into a product to be cut, the cutting edge contacts the product with a tension factor of at least 1:15.

13. A method for operating the slicing machine according to claim 11, wherein an oscillating movement of the blade axis relative to the product support is controlled in such a way that, for the purpose of dipping the blade into the product to be cut, contact of the cutting edge with the product to be cut takes place shortly after reversal of movement of the blade axis at its point furthest away from the product support.

14. The method according to claim 13, wherein the oscillating movement of the blade axis relative to the product support is controlled so that the cutting edge contacts the product to be cut with a tension factor of at least 1:15.

15. The blade according to claim 1, wherein the second surface adjoins at least one of the first surface or the deflector shoulder.

16. The blade according to claim 1, wherein the second surface adjoins the first surface and the deflector shoulder.

17. The blade according to claim 1, wherein the first connecting surface is spaced axially away from the blade plane by a first distance, and the multiple connecting surfaces include a second connecting surface that is spaced axially away from the blade plane by a second distance that is different than the first distance.

18. A rotatable blade with a front side and a back side, for use in a slicing machine, the blade comprising:

a curved peripheral edge formed as a cutting edge defining a blade plane;

a first surface on the back side of the blade that adjoins the cutting edge, wherein the first surface is inclined obliquely to the blade plane, extends radially inward relative to a blade axis of the blade and is at an acute cutting angle to the blade plane;

a second surface on the back side of the blade positioned radially inward of the first surface, wherein the second surface runs parallel to the blade plane;

multiple connecting surfaces on the back side of the blade, wherein a first connecting surface of the multiple connecting surfaces is positioned radially further inward from the second surface, and the first connecting surface is axially further away from the blade plane than the second surface; and a deflector shoulder that bridges an axial distance between the first connecting surface and the second surface, wherein the deflector shoulder is inclined obliquely to the blade plane;

wherein the second surface is arranged radially between the first surface and the deflector shoulder, the first connecting surface runs parallel to the blade plane, and the first connecting surface is arranged directly adjacent the deflector shoulder.

19. The blade according to claim 18, wherein thicknesses of the blade over an entire radial extension of the second surface differs by less than 0.5 mm.

20. The blade according to claim 18, wherein the multiple connecting surfaces comprise a second connecting surface that runs parallel to the blade plane, and the blade further comprises an additional deflector shoulder positioned between the first connecting surface and the second connecting surface.

21. A slicing machine comprising:

a cutting unit with the blade according to claim 18, and a product support for receiving a product.

* * * * *